United States Patent [19]

Jessen

[11] Patent Number: 4,609,149

[45] Date of Patent: Sep. 2, 1986

[54] INJECTION GUN SYSTEM FOR LAWN TREATMENT

[76] Inventor: Thomas Jessen, P.O. Box 8326, Merrillville, Ind. 46410

[21] Appl. No.: 699,486

[22] Filed: Feb. 7, 1985

Related U.S. Application Data

[63] Continuation of Ser. No. 518,830, Aug. 1, 1983, abandoned.

[51] Int. Cl.[4] ..... B05B 7/04

[52] U.S. Cl. ..... 239/310; 239/414; 239/416.2; 239/416.5; 239/527

[58] Field of Search ..... 239/304, 305, 404, 407, 239/416.4, 526, 527, 417.3, 416.5, 198, 416.2, 579, 310, 318, 414; 285/133 R, 134

[56] References Cited

U.S. PATENT DOCUMENTS

| | | | |
|---|---|---|---|
| 1,650,686 | 11/1927 | Binks | 239/527 X |
| 1,835,723 | 12/1931 | Salzer | 239/416.4 |
| 2,356,865 | 8/1944 | Mason . | |
| 2,571,871 | 10/1951 | Hayes . | |
| 2,612,403 | 9/1952 | Burch . | |
| 2,761,734 | 9/1956 | Farmer | 239/318 |
| 2,788,244 | 4/1957 | Gilmour . | |
| 2,788,245 | 4/1957 | Gilmour . | |
| 2,966,312 | 12/1960 | Wilson et al. | 239/318 X |
| 3,023,849 | 5/1960 | Tine | 239/318 X |
| 3,042,314 | 7/1962 | Packard et al. | 239/347 |
| 3,079,093 | 2/1963 | Bellows | 239/318 X |
| 3,112,884 | 12/1963 | Gilmour | 239/318 |
| 3,122,324 | 2/1964 | Lee . | |
| 3,191,869 | 6/1965 | Gilmour | 239/318 |
| 3,204,661 | 9/1965 | Young . | |
| 3,207,443 | 9/1965 | Gilmour | 239/312 |
| 3,231,200 | 1/1966 | Heald . | |
| 3,255,972 | 6/1966 | Hultgren et al. | 239/318 |
| 3,333,061 | 8/1967 | Lofgreen | 239/318 X |
| 3,632,046 | 1/1972 | Hengesbach | 239/318 |
| 3,638,681 | 2/1972 | Moore et al. | 137/607 |
| 3,897,004 | 7/1975 | French | 239/318 |
| 4,005,824 | 2/1977 | Becker et al. | 239/528 X |
| 4,043,510 | 8/1977 | Morris | 239/323 |
| 4,089,970 | 5/1978 | Strahman | 239/304 |
| 4,129,231 | 12/1978 | Larson | 222/145 |
| 4,170,070 | 10/1979 | Colgate et al. | 239/313 X |
| 4,238,074 | 12/1980 | Coons | 239/310 X |

FOREIGN PATENT DOCUMENTS

| | | |
|---|---|---|
| 1327806 | 4/1963 | France . |
| 734723 | 8/1955 | United Kingdom . |

*Primary Examiner*—Joseph F. Peters, Jr.
*Assistant Examiner*—Kevin P. Weldon
*Attorney, Agent, or Firm*—Edward W. Osann, Jr.

[57] ABSTRACT

An improved injection gun system for lawn treatment adapted to permit selective application of a treating fluid by the operator as an incident to application of a main stream fluid through a hand held injection gun. The system comprises a pressurized source of main stream fluid, a pressurized source of treating fluid, a reach of hose including a large diameter conduit connected to the main stream fluid source and a small diameter conduit connected to the treating fluid source, an injection gun connected to the large diameter conduit of the concentric hose, and a fail safe cut-off valve interposed between the small diameter treatment fluid conduit and the injection gun for controlling the injection of treatment fluid into the main stream passing therethrough.

10 Claims, 7 Drawing Figures

FIG. 1
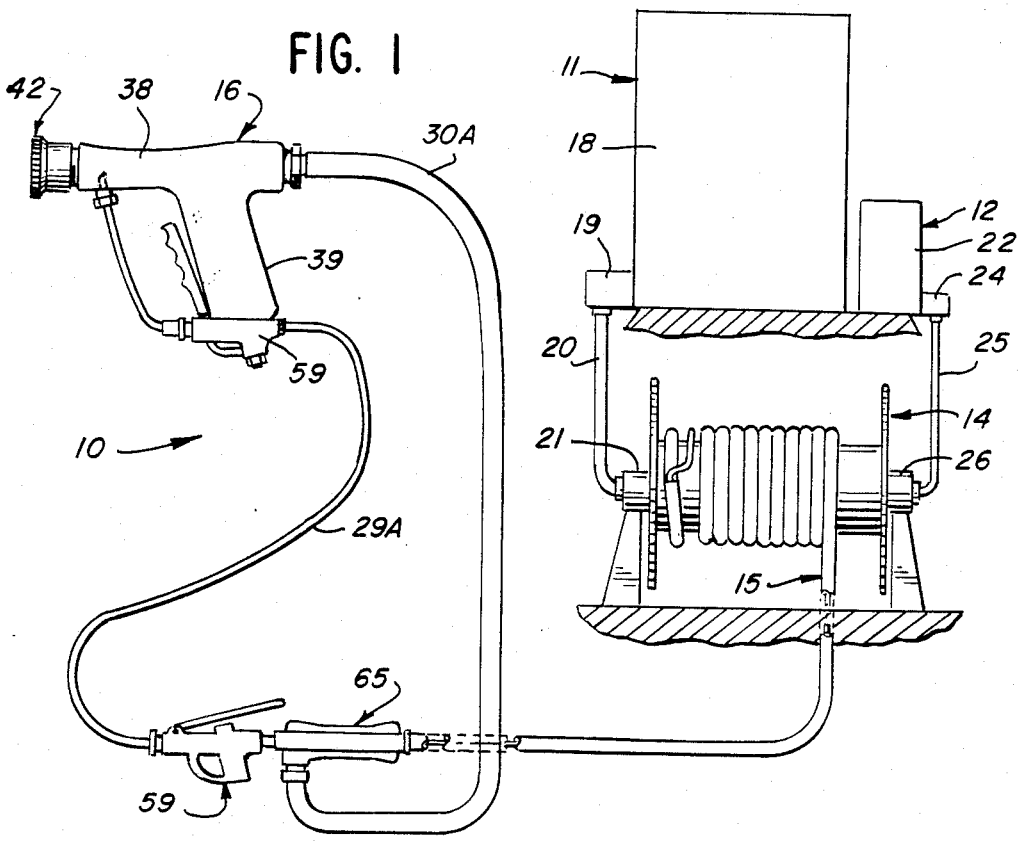
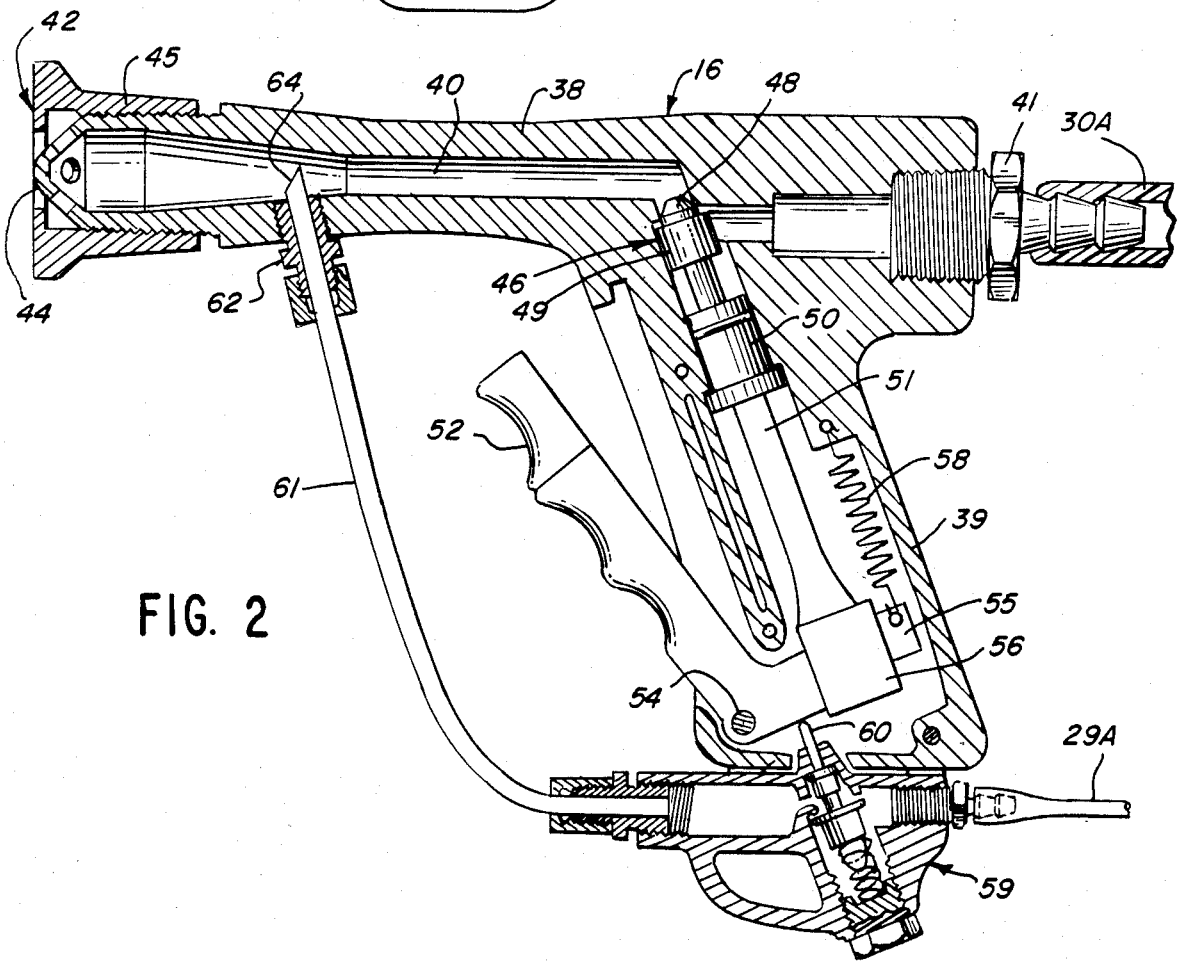
FIG. 2

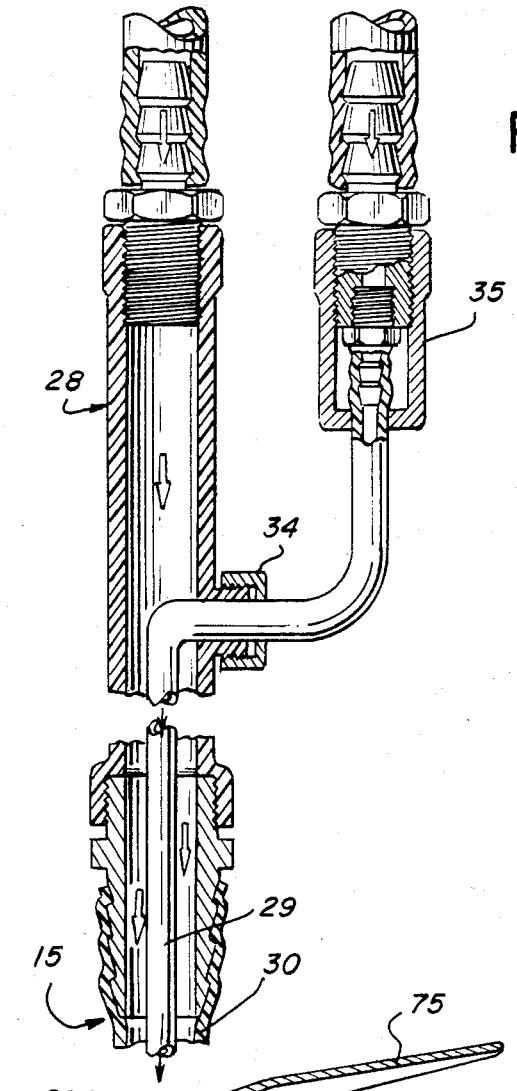
FIG. 3
FIG. 4
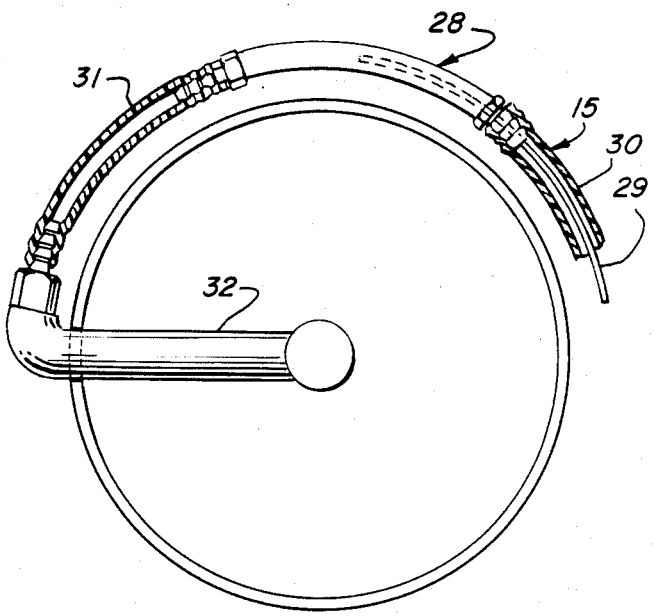
FIG. 5
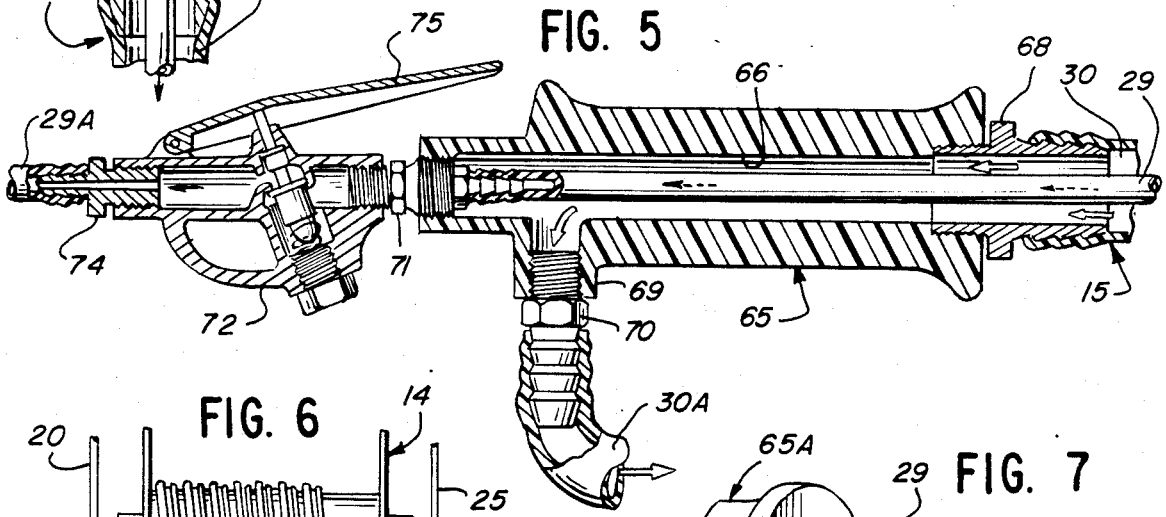
FIG. 6
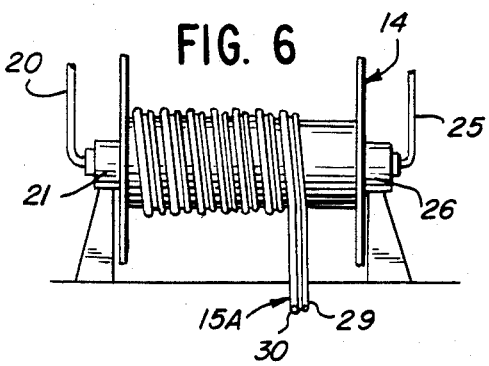
FIG. 7
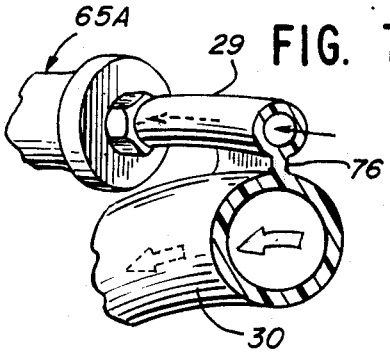

INJECTION GUN SYSTEM FOR LAWN TREATMENT

This application is a continuation of my copending application Ser. No. 518,830, filed Aug. 1, 1983, now abandoned.

BACKGROUND OF THE INVENTION

Lawn treatment has become an important service industry in this country, particularly in the suburban areas where single family homes and garden apartments are numerous. A typical service unit normally utilizes a manually operated spray gun system. Such a system includes a spray gun held by the operator, a service vehicle equipped with a supply tank containing a mixture of water, fertilizer, and treatment solution such as pesticide, and a length of hose connected between the gun and the supply tank on the service vehicle.

Other lawn treatment systems are known wherein the operator carries on his person a container of pesticide or herbicide which is metered into an injection gun, mixed with the fertilizer solution from the service vehicle, and then discharged as a spray on the lawn.

The operator's job, whether handling a conventional spray gun or an injection gun, is a demanding one. It requires a great deal of manual dexterity, coordination, concentration, and care because he is applying pesticides or herbicides which have been premixed in the fertilizer solution discharged by the gun. In many instances, he is carrying on his person a container of highly toxic chemicals. The job is also fatiguing because he must manipulate the gun while literally dragging with him long stretches of hose which may be up to 300 feet in length. Operator fatigue may result in improper or excessive application of pesticide or herbicide to the lawn or to adjacent gardens, shrubs or trees, causing severe damage.

SUMMARY OF THE INVENTION

The present invention relates in general to lawn treatment systems and, more specifically, to a novel improved injection gun system for applying a fertilizer solution and a treatment solution to a lawn.

One object of the present invention is to provide an injection gun system for lawn treatment adapted to permit selective application of pesticide or herbicide solution as an incident to application of a fertilizer solution through the injection gun.

Another object of the invention is to provide an injection gun system of the character set forth above wherein the operator has direct control of the treatment solution at all times during operation of the gun.

A further object of the invention is to provide an injection gun system of the foregoing type including a failsafe cut-off valve means in the treatment solution line at the operator's station which interrupts the flow of treatment solution automatically if the operator releases the trigger of the cut-off valve means.

Still another object of the invention is to provide an injection gun system of the above character which will be adapted to reduce operator fatigue by transferring the hose dragging function from the hand which operates the injection gun to other hand which is used to grip a crossover manifold.

The foregoing and other objects are accomplished in the present injection gun system by providing separate pressurized sources of main stream fertilizer solution or the like and treatment solution; a hose reel connected with each of these pressurized liquid sources; a concentric hose adapted to be stored on the hose reel; a first crossover manifold on the hose reel connecting the fertilizer solution source with the larger diameter component of the concentric hose and connecting the treatment solution source with the smaller diameter component of the concentric hose; a hand actuated injection gun adapted to mix treatment solution with fertilizer solution and to discharge the mixture in the form of a liquid spray applied to the lawn; a second crossover manifold adajacent to but spaced apart from the injection gun adapted to connect the large and small diameter components of the concentric hose to the injection gun; and failsafe valve means interposed between the treatment solution source and the injection gun under control of the operator for regulating the injection of treatment solution into the fertilizer solution passing through the injection gun.

Other objects and advantages of the invention will become apparent as the following description proceeds, taken together with the accompanying drawings.

BRIEF DESCRIPTION OF THE DRAWINGS

FIG. 1 is a diagramatic view of an illustrative injection gun system exemplifying the present invention.

FIG. 2 is an enlarged vertical section view through the injection gun of the system shown in FIG. 1.

FIG. 3 is an enlarged, fragmentary sectional view taken of the crossover manifold on the hose reel shown in FIG. 1.

FIG. 4 is a transverse sectional view through the hose reel and along the axis of the concentric hose of the crossover manifold on the hose reel.

FIG. 5 is an enlarged longitudinal sectional view along the axis of the crossover manifold and failsafe trigger valve associated therewith.

FIG. 6 is a diagramatic view of the hose reel carrying a dual conduit hose which may be used in lieu of the concentric hose in the system of FIGS. 1–5.

FIG. 7 is an enlarged, fragmentary perspective view of the dual conduit hose of FIG. 6 with one end shown in transverse section.

While the invention is susceptable of the various modifications and alternative constructions, certain preferred embodiments have been shown in the drawings and will be described below in considerable detail. It should be understood, however, that there is no intention to limit the invention to the specific forms described herein, but, on the contrary, the intention is to cover all modifications, alternative constructions, and equivalents falling within the scope of the appended claims.

DETAILED DESCRIPTION OF THE INVENTION

Referring more specifically to FIG. 1, the invention is there exemplified in an illustrative injection gun lawn treatment system 10. The latter comprises a source 11 of pressurized main stream fluid, in this instance a water solution of fertilizer, and a source 12 of pressurized treatment fluid, which may be a solution of pesticide or herbicide. The sources 11, 12 are respectively connected to opposite ends of a hose reel 14 that carries a concentric hose 15 which may be approximately 300 feet in length. The concentric hose 15 conducts the fertilizer solution and the treatment solution, unmixed, to a hand held injection spray gun 16. The pressurized fluid sources 11, 12, hose reel 14, and the fluid connections therebetween, are mounted on the service vehicle which may be a truck or trailer.

The pressurized main stream fluid source 11 comprises a reservoir 18 which may, for example, hold 300 to 500 gallons of fertilizer solution, and a distribution pump 19. The pump 19 discharges via a line 20 to a swivel fitting 21 at the left hand end of the hose reel as shown in FIG. 1. The pressurized treatment fluid source 12 comprises a relatively small reservoir 22 and a pump 24. The latter discharges via a line 25 to a swivel fitting 26 at the right hand end of the hose reel as shown in FIG. 1. The swivel fittings 21, 26 connect respectively with radial risers on the hose reel.

Referring more specifically to FIGS. 1, 3 and 4, it will be noted that the hose reel 14 is provided with a crossover manifold 28 adapted to connect the treatment solution line 25 with the small diameter conduit 29 concentrically housed within the larger diameter conduit 30 of the hose 15. The manifold 28 may be constructed of brass or other appropriate metal. Its upstream end is connected by a flexible conduit 31 to the radial riser 32 on the hose reel which communicates with the swivel fitting 21 and the fertilizer line 20. At its downstream end, the manifold 28 is connected to the concentric hose 15 including its small diameter conduit 29 and large diameter conduit 30. The small diameter conduit 29 passes radially through the wall of the manifold 28 which includes a suitable sealing gland 34. From the gland 34, the small diameter conduit 29 runs toward its upstream end where it connects with a metal coupling 35. The coupling 35, in turn, connects with a flexible conduit 36 which is coupled to a radial riser (not shown) on the hose reel which communicates with the swivel fitting 26 and the treatment solution line 25.

The injection gun 16 comprises a barrel 38 and a handle 39 which may be formed of plastic or other light weight material (FIG. 2). The barrel 38 has a longitudinal bore 40 of varying diameter extending therethrough. The bore 40 is connected at the rearward or breech end of the barrel via fitting 41 to the large diameter flexible conduit 30A which communicates with large diameter conduit 30 of concentric hose 15. The forward end portion of the barrel 38 and the bore 40 increase progressively in diameter, terminating in a spray nozzle 42. The latter may be defined by a perforated convex insert 44 extending across the bore 40 surrounded by an annular collar 45 threadedly connected to the insert and the barrel. The collar 45 and insert 44 may be disassembled from the barrel for cleaning.

The gun 16 includes a main regulating valve 46 interposed in the bore 40. The valve 46 comprises a valve disk 48 which engages a seat in the bore 40, a pair of guide bosses 49, 50, and an operating plunger 51. The regulating valve 46 is operated by means of trigger 52 pivotally mounted on post 54 in the handle and having a bell crank arm 55 which engages an enlarged socket 56 defined in the lower end of the plunger 51. A biasing spring 58 connected between the handle 39 and the projecting end of the bell crank arm 55 resiliently holds the valve 46 in a normally closed position.

Provision is made in the gun 16 for injecting and mixing the treatment solution into the main stream fertilizer solution shortly before discharge through the spray nozzle 42. In furtherance of such objective, a treatment solution regulating valve 59 is mounted on the lower end of the gun handle 39 (FIG. 2). The valve 59 is of the spring actuated plunger type and is biased toward a normally closed position. It is disposed so that its actuating plunger 60 extends into the handle 39 and operatively abuts against the bell crank arm 55 of the gun trigger 52. The regulating valves 46, 59 are thus adapted to operate in unison through trigger 52.

The valve 59 is connected at one end to flexible conduit 29A which, in turn, is connected to the treatment solution conduit 29. At its opposite end, the valve 59 is connected to a fixed conduit 61, in this instance a section of copper tubing, which sealingly engages an injection stem 62 on the barrel 38. The upper end portion 64 of the conduit 61 projects through the injection stem 62 and into the expanding portion of the barrel bore. The end portion 64 is cut off at an acute angle so as to define a downstream facing discharge opening spaced from the peripheral surface of the bore. This tends to increase turbulance and improve mixing of the treatment solution with the water and fertilizer solution prior to discharge from the gun 16. By reason of the foregoing construction, actuation of the trigger 52 by the operator will result in simultaneous opening, or simultaneous closing, of the mainstream regulating valve 46 and the treatment solution regulating valve 59.

Means are provided for giving the operator direct control over the injection of treatment solution into the mainstream discharge from the gun 16 and, at the same time, freeing the gun from the load caused by the long length of hose which drags behind the operator. This permits the operator to manipulate and direct the gun without interference from the main length of hose, improving accuracy and reducing fatigue. In addition, the operator is left free to use his other hand for dragging the hose and precisely controlling the supply of treatment solution to the gun.

The foregoing objective is accomplished by the use of a hand-held crossover manifold 65 (FIGS. 1 and 5) interposed between the main hose 15 and the flexible conduit lines 30A, 29A between the manifold 65 and the gun 16. The manifold 65 has a main stream passage 66 running axially thereof. A concentric hose fitting 68 connects the right hand end of the manifold 65 (as viewed in FIG. 5) with the downstream end of the large diameter conduit of the concentric hose 15. Adjacent its opposite end, the manifold 65 is formed with an outlet thimble 69 and main stream fitting 70. The latter is connected to one end of the flexible main stream conduit 30A, the opposite end of which is connected to the rearward end of the gun barrel via fitting 41. The left hand end of the passage 66 (as viewed in FIG. 5) terminate in a connecting fitting 71 which is coupled to the treatment solution conduit 29, the latter extending through the concentric hose fitting 68 and through the passage 66 to the fitting 71. The opposite end of the fitting 71 has coupled thereto a normally closed safety cut-off valve 72 connected by fitting 74 to one end of the flexible treatment solution conduit 29A. The opposite end of the conduit 29A is connected to the regulating valve 59 on the gun 16. The safety cut-off valve 72 may be opened by means of a failsafe trigger 75 which the gun operator may actuate with his thumb while holding the manifold 65 with the hand remote from the gun. Gripping of the manifold may be facilitated by enlarging the outer diameter thereof adjacent each end.

The foregoing arrangement gives the operator complete control over the injection of treating solution to the main stream fluid being discharged from the gun. As long as the trigger 52 on the gun holds the valves 46 and 59 open, and the failsafe trigger 75 of valve 72 is depressed, treatment solution will be injected into the barrel of the gun and mixed with the main stream solution passing therethrough. If the operator releases the trigger 75, due to intent or due to inadvertence, the flow of treatment solution is immediately cut-off.

Turning next to FIGS. 6 and 7, there is shown a dual conduit hose of extruded rubber or the like which may be used in lieu of the concentric hose in the system of FIG. 1. In this instance, the main stream conduit is of large diameter and the treatment solution conduit is of relatively small diameter. The two conduits are joined together side by side by a continuous integral rib 76. This permits the dual conduit hose to be connected directly to the radial risers on the hose reel 14, eliminating the hose reel crossover manifold and permitting the dual conduit hose to be wound directly on the reel as shown in FIG. 6. A crossover manifold 65A would still be used and in this instance the treatment solution conduit 29 would be connected directly to the end of the manifold 65A and extended therethrough to the fitting 71 which supports the normally closed regulating valve 72. Instead of connecting the large diameter conduit 30 to the inner passage 66 of the manifold, the outlet thimble is plugged or eliminated and the large diameter conduit is connected directly to the gun 16 or to a short section of flexible conduit connected to the gun 16.

In view of all the foregoing, it will be appreciated that the present invention effectively reduces fatigue on the part of the injection gun operator. It eliminates the necessity to carry on his person a separate container of toxic pesticide or herbicide solution. It minimizes the weight of the injection gun, leaving the cut-off valve and crossover manifold to be carried in his left hand. It also avoids drag on the injection gun from the main hose by interposing flexible connecting conduits between the main hose and the injection gun. All of these advantageous features of the present invention combine to lighten the operator's burden as compared to that in systems of the kind heretofore known.

I claim as my invention:

1. An injection gun system for lawn treatment adapted to permit application of a treating fluid and a main stream fluid through an injection gun, comprising, in combination:

(a) a first pressurized source for main stream fluid;
(b) a second pressurized source for treating fluid;
(c) a reach of hose comprising a main stream fluid conduit and a treating fluid conduit, each said conduit having an upstream end and a downstream end;
(d) means connecting the upstream end of said main stream fluid conduit to said first pressurized source and the upstream end of said treating fluid conduit to said second pressurized fluid source;
(e) an injection gun having an input connection for main stream fluid and an input connection for treating fluid;
(f) a hand held manifold disposed adjacent to but spaced apart from said injection gun and having main stream fluid conduit connections and treating fluid conduit connections thereon;
(g) means connecting the downstream end of said main stream conduit to a respective main stream conduit connection on said manifold;
(h) means connecting the downstream end of said treating fluid conduit to a respective treating fluid conduit connection on said manifold;
(i) a first flexible conduit interposed between a main stream fluid conduit connection on said manifold and said main stream fluid input connection on said gun; and
(j) a second flexible conduit interposed between a treating fluid conduit connection on said manifold and said treating fluid input connection on said gun.

2. An injection gun system as defined in claim 1 wherein said treating fluid conduit is concentric with said main stream fluid conduit.

3. An injection gun system as defined in claim 1 wherein said treating fluid conduit is joined in side by side relation with said main stream fluid conduit.

4. An injection gun system as defined in claim 1 wherein valve means is interposed between said hand held manifold and said gun to permit selective application of treating fluid as an incident to application of main stream fluid through said gun.

5. An injection gun system for lawn treatment comprising, in combination:

(a) a pressurized source of main stream fluid;
(b) a pressurized source of treating fluid;
(c) a hose reel connected with each of said pressurized fluid sources;
(d) a concentric hose adapted to be stored on said hose reel, said concentric hose comprising a large diameter outer fluid conduit and a substantially smaller diameter inner fluid conduit;
(e) a first crossover manifold on said hose reel connecting said main stream fluid source with said large diameter conduit of said concentric hose and connecting said treating fluid source with said smaller diameter conduit of said concentric hose;
(f) a hand actuated injection gun adapted to mix treatment fluid with main stream fluid and to discharge the mixture in the form of a spray;
(g) a hand held second crossover manifold adjacent to but spaced from said injection gun adapted to connect said large and small diameter components of said concentric hose to said spray gun;
(h) means interposed between said second crossover manifold and said spray gun for controlling the flow of treatment fluid through said gun; and
(i) said treatment fluid control means includes a trigger actuated safety cut-off valve on said second crossover manifold.

6. An injection gun system for lawn treatment comprising, in combination:

(a) a pressurized source of main stream fluid;
(b) a pressurized source of treating fluid;
(c) a hose reel connected with each of said pressurized fluid sources;
(d) a concentric hose adapted to be stored on said hose reel, said concentric hose comprising a large diameter outer fluid conduit and a substantially smaller diameter inner fluid conduit;
(e) a first crossover manifold on said hose reel connecting said main stream fluid source with said large diameter conduit of said concentric hose and connecting said treating said treating fluid source with said smaller diameter conduit of said concentric hose;
(f) a hand actuated injection gun adapted to mix treatment fluid with main-stream fluid and to discharge the mixture in the form of a spray;
(g) a second crossover manifold adjacent said injection gun adapted to connect said large and small diameter components of said concentric hose to said spray gun;

(h) means interposed between said second crossover manifold and said spray gun for controlling the flow of treatment fluid through said gun; and (i) said treatment fluid control means comprising a trigger actuated safety cut-off valve on said second crossover manifold and a trigger actuated regulating valve on said spray gun.

7. An injection gun system for lawn treatment adapted to permit selective application of a treating fluid by the operator as an incident to application of a main stream fluid through an injection gun and comprising, in combination:

(a) a pressurized source of main stream fluid;

(b) a pressurized source of treating fluid;

(c) a reach of hose comprising a main stream fluid conduit and a treating fluid conduit;

(d) means connecting one end of each said hose conduit to a respective one of said pressurized fluid sources;

(e) an injection gun having an input connection for main stream fluid and an input connection for treating fluid, said gun being adapted to be aimed and manipulated by one hand of the operator;

(f) a manifold disposed adjacent to but spaced from said injection gun and adapted to be held by the operator in the other hand, said manifold having main stream fluid connections and treating stream fluid connections thereon;

(g) means connecting the other end of each said hose conduit to a respective main stream or treating fluid connection on said manifold;

(h) a first flexible conduit interposed between a main stream fluid conduit connection on said manifold and the main stream fluid input connection on said gun;

(i) a second flexible conduit interposed between a treating fluid conduit connection on said manifold and the treating fluid input connection on said gun; and (j) trigger actuated valve means interposed between said second flexible conduit and a treating fluid connection on said manifold to permit selective application of treating fluid incident to discharge of main stream fluid from said gun.

8. The injection gun system defined in claim 7 wherein said valve means comprises a trigger actuated safety cut-off valve on said manifold and a trigger actuated regulating valve on said injection gun.

9. In an injection gun system for lawn treatment having a pressurized source of main stream liquid solution and a pressurized source of treating liquid solution, an injection gun comprising, in combination:

(a) a barrel having a longitudinal bore therethourgh, said bore having a diameter increasing toward the forward end of said barrel;

(b) a handle fixed to said barrel;

(c) a main stream solution input connection at the breech end of said barrel;

(d) a main stream solution regulating valve in said barrel;

(e) a trigger pivotally mounted on said handle and operatively connected to said main stream regulating valve;

(f) a treating solution regulating valve fixed to said handle and disposed for operative engagement by said trigger;

(g) said treating solution regulating valve having an input connection and an output connection;

(h) a fixed conduit on said gun interposed between said treating solution output connection and a passage communicating with the forward end portion of said barrel;

(i) said fixed conduit having an end portion extending through said passage into said increasing diameter section of said longitudinal bore and difining an injection discharge opening in the main stream solution and spaced from the peripheral surface of said bore.

10. The combination set forth in claim 9, wherein said end portion of said fixed conduit extending into said longitudinal bore is cut at an acute angle defining an opening facing downstream and spaced from the peripheral surface of said bore.

* * * * *